US011035057B2

(12) United States Patent
Stephan et al.

(10) Patent No.: US 11,035,057 B2
(45) Date of Patent: Jun. 15, 2021

(54) CLEANING DEVICE FOR CLEANING A ROTOR DISK OF A SPINNING ROTOR

(71) Applicant: Maschinenfabrik Rieter AG, Winterthur (CH)

(72) Inventors: Adalbert Stephan, Beilngries/Paulushofen (DE); Harald Widner, Ingolstadt (DE); Christian Kettner, Koesching (DE); Frank Baier, Hohenwart (DE)

(73) Assignee: Maschinenfabrik Rieter AG, Winterthur (CH)

( * ) Notice: Subject to any disclaimer, the term of this patent is extended or adjusted under 35 U.S.C. 154(b) by 546 days.

(21) Appl. No.: 15/662,996

(22) Filed: Jul. 28, 2017

(65) Prior Publication Data

US 2018/0030625 A1 Feb. 1, 2018

(30) Foreign Application Priority Data

Jul. 29, 2016 (DE) ..... 10 2016 114 082.1

(51) Int. Cl.

| | |
|---|---|
| ***D01H 11/00*** | (2006.01) |
| ***B08B 5/02*** | (2006.01) |
| ***B08B 9/00*** | (2006.01) |
| ***B08B 1/00*** | (2006.01) |
| ***D01H 4/24*** | (2006.01) |

(52) U.S. Cl.

CPC ..... *D01H 11/005* (2013.01); *B08B 1/005* (2013.01); *B08B 5/02* (2013.01); *B08B 9/00* (2013.01); *D01H 4/24* (2013.01)

(58) Field of Classification Search

CPC .. B08B 1/005; B08B 5/02; B08B 9/00; D01H 11/005; D01H 4/24

See application file for complete search history.

(56) References Cited

U.S. PATENT DOCUMENTS 4,125,991 A * 11/1978 Stahlecker ..... D01H 4/24 15/304
4,403,472 A * 9/1983 Lattion ..... D01H 4/24 57/302

(Continued)

FOREIGN PATENT DOCUMENTS

CN 1644775 A 7/2005
CN 103305981 A 9/2013

(Continued)

OTHER PUBLICATIONS

EPO Search Report, dated Dec. 19, 2017.
German Search Report, dated Apr. 28, 2017.
CN Office Action, dated Apr. 6, 2021.

*Primary Examiner* — Marc Carlson
(74) *Attorney, Agent, or Firm* — Dority & Manning, P.A.

(57) ABSTRACT

A cleaning device for cleaning a rotor disk of a spinning rotor has a cleaning head with at least one cleaning element, and a receptacle on which the cleaning head is mounted and which can be fed to the spinning rotor for cleaning the rotor disk. The cleaning head includes at least one bearing area by means of which the cleaning head is mounted on the receptacle. A longitudinal direction of the bearing area defines an axial direction of the cleaning head. The cleaning head is mounted in the axial direction in a floating manner on the receptacle, and/or the cleaning element is mounted in the axial direction in a floating manner on the cleaning head.

11 Claims, 3 Drawing Sheets

(56) References Cited

U.S. PATENT DOCUMENTS

| | | | | | |
|---|---|---|---|---|---|
| 4,480,433 | A * | 11/1984 | Ryer, II | D01H 4/24 | 15/21.1 |
| 4,542,620 | A * | 9/1985 | Kase | D01H 4/24 | 57/302 |
| 4,897,993 | A * | 2/1990 | Raasch | D01H 4/24 | 57/302 |
| 5,083,421 | A * | 1/1992 | Raasch | D01H 4/24 | 57/301 |
| 6,516,600 | B2 * | 2/2003 | Paweletz | D01H 4/24 | 57/302 |
| 6,910,326 | B2 * | 6/2005 | Stephan | D01H 4/24 | 57/302 |
| 2002/0073685 | A1 * | 6/2002 | Paweletz | D01H 4/24 | 57/404 |
| 2003/0177750 | A1 * | 9/2003 | Limmer | D01H 4/22 | 57/300 |
| 2004/0079068 | A1 | 4/2004 | Stephan et al. | | |

FOREIGN PATENT DOCUMENTS

| | | | | |
|---|---|---|---|---|
| DE | 37 15 934 | A1 | 11/1988 | |
| DE | 102 04 108 | A1 | 7/2003 | |
| DE | 102 31 484 | A1 | 9/2003 | |
| DE | 103 14 936 | A1 | 2/2004 | |
| DE | 10314936 | A1 * | 2/2004 | D01H 4/24 |
| EP | 0 071 893 | B1 | 5/1985 | |
| EP | 1 201 800 | A1 | 5/2002 | |
| EP | 1 344 852 | A2 | 9/2003 | |

* cited by examiner

CLEANING DEVICE FOR CLEANING A ROTOR DISK OF A SPINNING ROTOR

FIELD OF THE INVENTION

The present invention relates to a cleaning device for cleaning a rotor disk of a spinning rotor. The cleaning device features a cleaning head, which features at least one cleaning element for cleaning the spinning rotor, and one receptacle, in which the cleaning head is mounted and which can be fed to the spinning rotor for cleaning. The cleaning head features at least one bearing area, the longitudinal direction of which defines an axial direction of the cleaning head.

BACKGROUND

DE 103 14 936 A1 discloses a cleaning device that features a cleaning head with a scraper as a cleaning element. Herein, the cleaning head can be fed to the spinning rotor by means of a feed unit, such that the cleaning element is able to reach the interior of the spinning rotor and is able to clean it on its inner side. Since, in particular, the rotor groove of the spinning rotor requires intensive cleaning, with such cleaning devices, it is always essential that they are positioned relatively precisely with respect to the rotor groove during cleaning. Therefore, the cleaning head of DE 103 14 936 A1 features a stop element, by means of which the cleaning head, upon being fed, makes contact with the spinning rotor, and is thereby positioned in the axial direction with respect to the spinning rotor. However, based on various causes, the incorrect positioning of the cleaning head with respect to the spinning rotor may occur.

SUMMARY OF THE INVENTION

Therefore, a task of the present invention is to propose a cleaning device that, in a simple manner, enables the precise positioning of the cleaning device with respect to the spinning rotor. Additional objects and advantages of the invention will be set forth in part in the following description, or may be obvious from the description, or may be learned through practice of the invention.

The task is solved by a cleaning device with the characteristics as described and claimed herein.

The proposed cleaning device for cleaning a rotor disk of a spinning rotor features a cleaning head, which includes at least one cleaning element for cleaning the spinning rotor, and one receptacle, in which the cleaning head is mounted and which can be fed to the spinning rotor for cleaning. Herein, the feed of the receptacle to the spinning rotor can take place by means of a feed unit, which may feature, for example, a pneumatic cylinder, a linear drive, or another drive. The cleaning head features at least one bearing area, in particular a cylindrical bearing area, the longitudinal direction of which defines an axial direction of the cleaning head. Here, the longitudinal direction of the bearing area is understood to be the direction of the greatest longitudinal extent of the bearing area. If the bearing area is a cylindrical bearing area, the direction of a longitudinal axis of the cylinder is understood as the longitudinal direction. The cylindrical area may be designed to be circular cylindrical or, in the sense of a mathematical definition of the term "cylinder," may be based on any other base area that has been extruded along a guide curve. Thus, the direction of the guide curve defines the longitudinal axis of the cylinder.

It is now provided that the cleaning head is mounted in a free-floating manner on the receptacle in the axial direction of the cleaning head. As an alternative or in addition, it is proposed that the at least one cleaning element is mounted in a floating manner on the cleaning head in the axial direction. Here, a floating mounting is understood to be a mounting in which the cleaning head and/or the cleaning element is mounted in a freely movable manner in both axial directions, and is thus not fixed in the axial direction, and is also not acted upon in another manner, for example by a spring force.

By means of this freely floating mounting, it is possible for the cleaning head to adjust itself automatically and independently in the axial direction with respect to the spinning rotor upon the feeding of the cleaning device to the spinning rotor. In particular, this makes it possible to align the cleaning element precisely with respect to the rotor groove. Herein, based on the free mobility in both axial directions, a correct alignment or fine adjustment of the cleaning element or of the cleaning head is possible, both when the cleaning device or the receptacle is fed too close to the spinning rotor by means of the feed unit, or when the feed unit positions the cleaning device too far away from the spinning rotor.

According to an advantageous design of the invention, the backlash of the cleaning head and/or of the at least one cleaning element, in the axial direction, amounts to at least 2 mm, preferably at least 3 mm, and more preferably at least 4 mm. It has been shown that a backlash of this magnitude is sufficient to compensate for any possible imprecise positioning of the receptacle by the feed unit, or to achieve a fine adjustment of the cleaning head by means of the free axial mobility.

It is advantageous if the cleaning head features an air supply and the at least one cleaning element can be actuated by means of compressed air. Herein, the air guidance or the compressed air for actuating the cleaning element may also advantageously serve the purpose of moving the cleaning head with respect to the receptacle and/or the cleaning element with respect to the cleaning head.

According to a first advantageous design, the cleaning element is a scraper, which is mounted on the cleaning head such that it can be extended, in particular pivoted around a scraper axis. The scraper may be extended, for example, by means of being subjected to compressed air via a piston. However, it is also conceivable to extend the scraper or scrapers by means of a motor, whereas a linear extension of the scraper would, of course, also be possible.

In doing so, it is particularly advantageous if, by extending the scraper, the cleaning head can be positioned in the axial direction with respect to a rotor groove of the spinning rotor to be cleaned. Upon the extension, based on the feed by the feed unit, the scraper initially arrives at a specific point on the rotor base or the rotor slide wall, and slides by itself up to the rotor groove as a result of the slope of the rotor base or the rotor slide wall, and as a result of the diameter increasing in the direction of the rotor groove during the further extension.

According to another advantageous design, the cleaning element is a blow hole, which can be subjected to compressed air through the air supply of the cleaning head. However, it is also conceivable that a scraper or another mechanical cleaning element along with a blow hole, possibly also a multiple number of blow holes, are arranged on the cleaning head.

Herein, it is once again advantageous if, through the subjecting of the blow hole with compressed air, the cleaning head can be positioned in the axial direction with respect to the spinning rotor to be cleaned, in particular with respect to a rotor groove of the spinning rotor.

Herein, according to an advantageous additional form of the cleaning device, the cleaning head features a stop, by means of which it can be positioned in the axial direction with respect to the spinning rotor to be cleaned, in particular with respect to a rotor groove of the spinning rotor to be cleaned. Thus, in this case as well, a highly precise alignment of the cleaning head with respect to the spinning rotor can be achieved.

It is advantageous if the receptacle features an air chamber, which is in connection with the air supply through at least one overflow opening. The air chamber can be subjected to compressed air through the overflow opening, and the cleaning head or the cleaning element can thereby be moved in the axial direction.

Herein, it is in turn particularly advantageous if the air chamber features an exhaust opening, which is preferably allocated with a shut-off valve. Thus, it is possible to selectively enable or prevent the cleaning element or the cleaning head to be moved by compressed air. For example, the prevention of the movement of the cleaning head can be advantageous if an additional cleaning element, which is positioned in a different way with respect to the spinning rotor or is fed to it, is to be used. The additional cleaning element can also be arranged on the cleaning head. Likewise, an exhaust opening that can be shut off may be advantageous in order to be able to optionally equip the cleaning device with various cleaning heads.

In an advantageous design, the cleaning head may feature both one scraper or multiple scrapers along with one blow nozzle or multiple blow nozzles as cleaning elements.

BRIEF DESCRIPTION OF THE DRAWINGS

Further advantages of the invention are described in the following embodiments. The following is shown.

DETAILED DESCRIPTION

Figure 1:
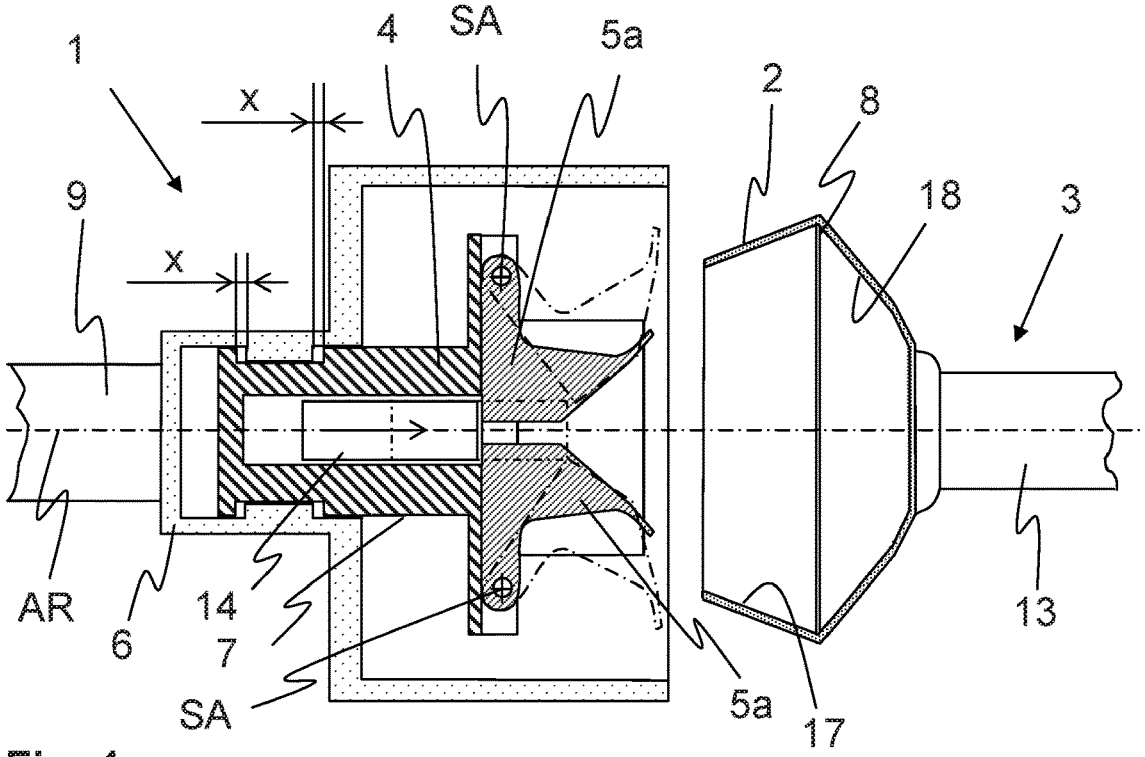
FIG. 1 is a schematic, sectional view of a cleaning device and a spinning rotor in a first position.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a cleaning device 1 for cleaning a rotor disk 2 of a spinning rotor 3. The spinning rotor 3 features, in addition to the rotor disk 2, a rotor shaft 13, on which the rotor disk 2 is fastened in a fixed manner or a detachable manner. Upon the spinning of fiber material, the operation of open-end rotor spinning devices always results in contamination, particularly on the inner side of the spinning rotor. The contamination may differ depending on the fiber material used or the degree of cleaning of the fiber material, and may also contain heavy buildups on the inner side of the spinning rotor 3. In particular, the rotor groove 8 is herein subjected to considerable contamination, which adversely affects the further spinning process. Therefore, the spinning rotors 3 must be cleaned regularly, in particular in the area of the rotor groove 8, for which the cleaning device 1 is provided.

The cleaning device 1 includes a receptacle 6, which can be fed to the spinning rotor 3 by means of a feed unit 9 (which is only indicated schematically here), and on which a cleaning head 4 for cleaning the spinning rotor 3 is arranged. The cleaning device 1 may be arranged by means of the feed unit 9 (for example) on a maintenance device that can be moved along the spinning positions of an open-end rotor spinning machine, whereas the feed unit 9 may include a pneumatic cylinder, an electric linear drive, or another drive, in order to feed the receptacle 6 with the cleaning head 4 to the spinning rotor 3. The maintenance device and the open-end rotor spinning device are not shown. The receptacle 6 of the present cleaning device surrounds the spinning rotor 3 in the shape of a pot, and may contain a rotary drive, by means of which the spinning rotor 3 can be driven during its cleaning. However, it is also possible for the spinning rotor 3 to be set into rotation by means of a drive arranged on the open-end rotor spinning device. In addition, it is, of course, also conceivable to carry out a cleaning of the spinning rotor 3 without a rotary movement.

For cleaning the spinning rotor 3 or the rotor groove 8, the present cleaning head 4 features, as cleaning elements 5, two scrapers 5*a*, which are mounted on the cleaning head 4 so as to be pivotable around a scraper axis SA. The pivoting out of the scrapers 5*a*, which can be actuated, for example, by means of a piston 14, is here indicated by a dash-dotted line. The piston 14 is herein moved to the right, as indicated by the arrow. The piston 14 may be actuated pneumatically, for which the cleaning head 4 features an air supply 10 (see FIGS. 4-6) and can be subjected to compressed air. However, it is also possible to extend the scraper 5*a* by means of a motor, or in a different manner. Therefore, the present view is to be understood as merely exemplary. The cleaning head 4 features at least one bearing area 7, which in the present case is formed in a cylindrical manner by its outer diameter on the area turned towards the receptacle 6, and which defines an axial direction AR of the cleaning head 4 through its longitudinal axis, here the center longitudinal axis. However, the cleaning head 4 may, of course, also feature additional or other cylindrical areas or bearing areas 7, which define the axial direction AR.

With the illustrated cleaning device 1, the cleaning head 4 is now mounted in the axial direction AR in a floating manner on the receptacle 6, and features an axial backlash. In the present case, the cleaning head 4 is shown in a middle position, in which it features a backlash in the axial direction AR with respect to the receptacle 6, as represented by the two gaps x. As an alternative to the view that is shown, however, it would also be possible for the cleaning head 4 itself to be mounted on the receptacle 6 in a fixed manner (i.e., without any backlash), and a gap to be provided between the scraper or scrapers 5*a* and the cleaning head 4.

In the following descriptions of FIGS. 2 to 6, the same reference signs are used for characteristics that are identical or at least comparable to the design shown in FIG. 1 or the position of the cleaning device 1 shown in FIG. 1. If they are not explained once again in detail, their design and/or modes of operation correspond to the design and mode of operation of the characteristics described above. Thus, the differences with FIG. 1 will be primarily discussed below.

Figure 2:
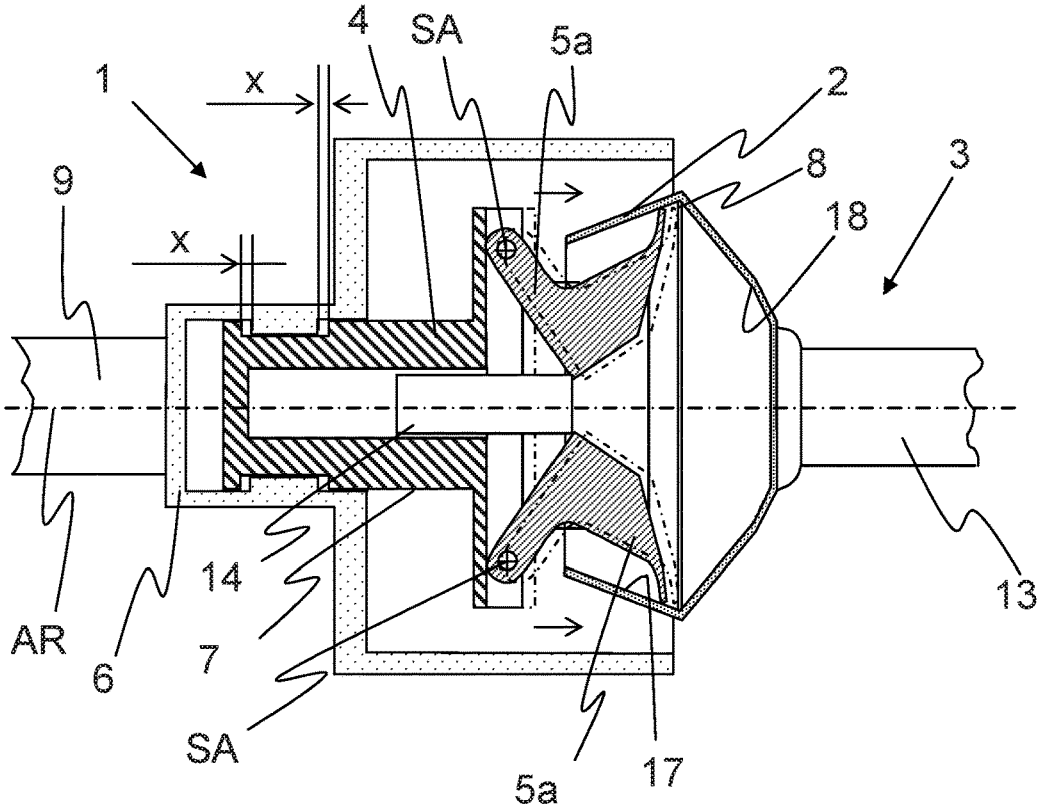
FIG. 2 is the cleaning device of FIG. 1 in a second position, in which it is fed to the spinning rotor.

FIG. 2 shows the cleaning device 1 of FIG. 1 in a second position, in which the cleaning head 4 has already been fed to the spinning rotor 3 by means of the receptacle 6 and the feed unit 9. Herein, the problem often arises that, based on adjustment errors of the cleaning device 1 with respect to the feed unit 9 or the movable maintenance device, based on positional deviations of the maintenance device with respect to the spinning position, based on a backlash between the various components or based on other causes, the positioning of the cleaning device 1 cannot take place precisely in the axial direction with respect to the spinning rotor 3, such that the cleaning elements 5 often cannot precisely reach the rotor groove 8. At that point, the reliable cleaning of the rotor groove 8 is no longer possible.

In the example shown in FIG. 2, the cleaning device 1 is, for example, positioned too far away from the spinning rotor 3 in the axial direction AR. Therefore, upon the extension of the scrapers 5*a*, they do not arrive in the rotor groove 8, but instead make contact with the rotor slide wall 17 of the rotor disk 2. However, due to the further impact of the piston 14 or another actuating element, for example a motor, and of the diameter increasing in the direction of the rotor groove 8, the cleaning head 4 is now moved in the axial direction AR with respect to the receptacle 6, while eliminating at least one part of the axial backlash (see arrows). Herein, the scrapers 5*a* slide along the slope of the rotor slide wall 17 into the rotor groove 8, and are now correctly positioned with respect to it, as indicated by the dash-dotted line. Based on the diameter of the rotor disk 2, which decreases once again in the area of the rotor base 18, an increased expenditure of force would be required for the further axial displacement of the cleaning head 4, such that no further movement of the cleaning head 4 takes place.

Figure 3:
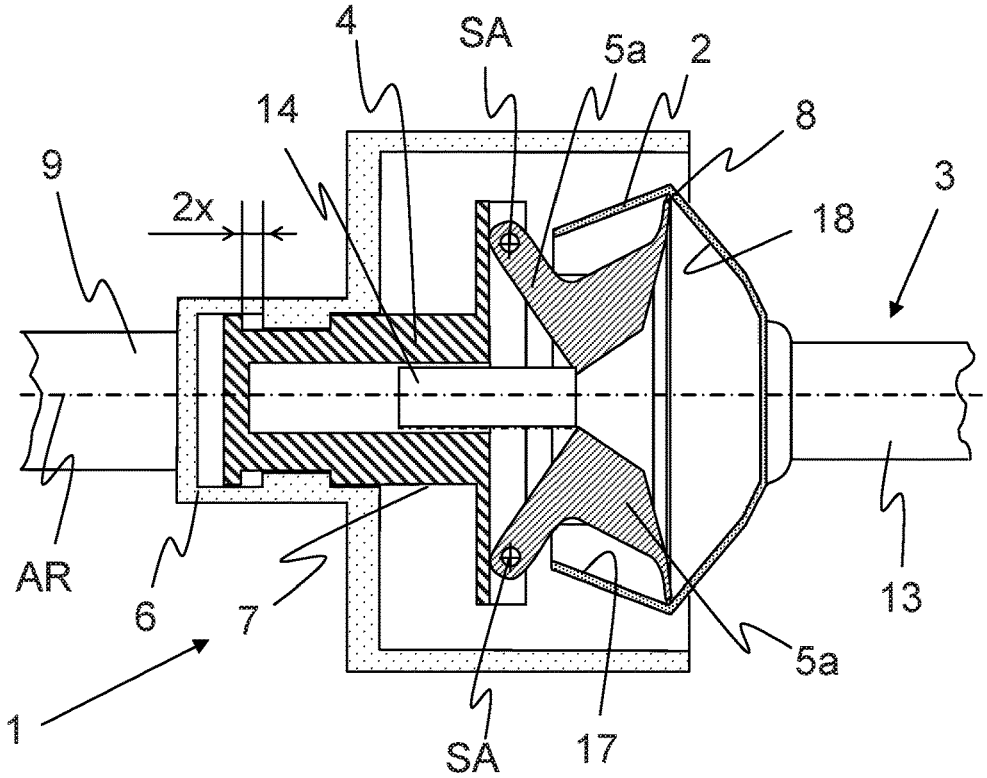
FIG. 3 is the cleaning device of FIG. 1 in an additional position, in which it is fed to the spinning rotor.

FIG. 3 shows another position of the cleaning device 1, in which the cleaning device 1 has already been fed to the spinning rotor 3, and the cleaning head 4 has already positioned itself correctly with respect to the rotor groove 8. In the example shown in FIG. 3, the cleaning device 1 has been positioned too close to the spinning rotor 3, such that the scrapers 5*a* have initially impinged on the rotor base 18 of the spinning rotor 3. Based on the further impact of the piston 14 or of the actuating element of the scrapers 5*a*, the scrapers 5*a* herein have been slid along the slope of the rotor base 18 in the direction of the larger diameter of the rotor groove 8, whereas, in turn, the backlash between the cleaning head 4 and the feed unit 6 in turn has been at least partially eliminated on the one side of the cleaning head 4. In the present case, the cleaning head 4 is shown in its fully retracted position with respect to the receptacle 6, such that a gap 2x now arises between the cleaning head 4 and the receptacle 6 in the left area of the figure. Of course, the cleaning head 4 does not have to be displaced by the complete gap x or 2x; rather, different intermediate positions are also possible depending on the gap of the cleaning head 4 from the spinning rotor 3 after feeding.

Figure 4:
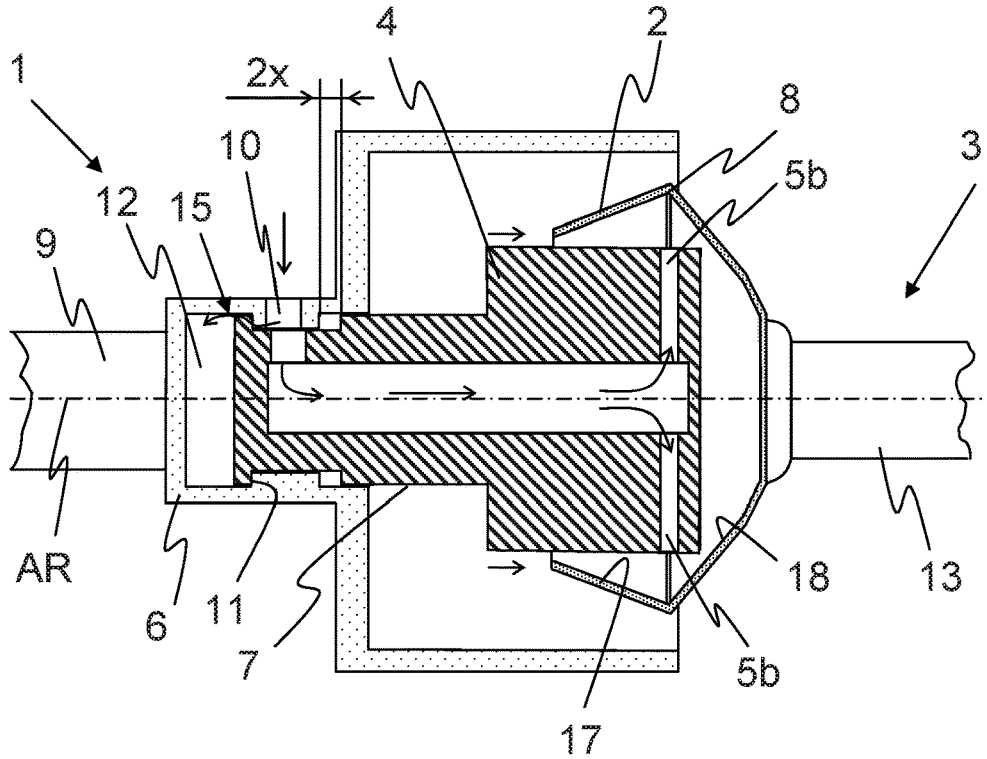
FIG. 4 is a schematic, sectional view of a cleaning device according to another design.

FIG. 4 shows an additional design of a cleaning device 1, with which the cleaning element 5 is formed not by a scraper 5*a*, but by a blow hole 5*b*. The cleaning head 4 herein features an air guide 10, through which compressed air can be fed to the cleaning head 4. By means of the compressed air fed via the air supply 10, the blow hole 5*b* is in turn subjected to compressed air. In the present case, two mutually opposite blow holes 5*b* are shown. Herein, through the subjecting of the blow hole 5*b* with compressed air, the cleaning head 4 is in turn positioned in the axial direction AR with respect to the spinning rotor 3. This is achieved by the fact that the cleaning device 1 or the receptacle 6 of the cleaning device 1, as the case may be, features an air chamber 12, which is in connection with the air supply 10 through at least one overflow opening 15.

In the present case, the overflow opening 15 is formed only by an annular gap between the housing 9 and the cleaning head 4, as symbolized by a small, curved arrow. However, a defined overflow opening 15 can also be provided between the cleaning head 4 and the air chamber 12. If compressed air arrives in the air chamber 12 through the overflow opening 15, this results in the entire cleaning head 4 being displaced with the blow hole or holes 5*b* in the axial direction AR of the cleaning head 4, as symbolized in the present case by the two small arrows near the cleaning head 4. Thereby, the position of the cleaning head 4 with respect to the spinning rotor 3 can be adjusted. According to the present example, the cleaning head 4 features a stop 11, which works together with a corresponding stop of the receptacle 6. Thereby, the cleaning head 4 with the blow hole 5*b* can be brought very close to the rotor groove 8 and thereby positioned with respect to it. Since cleaning by means of a blow hole 5*b* does not require a precise alignment of the cleaning element 5 with respect to the rotor groove 8, like cleaning by means of a scraper 5*a*, a good alignment of the blow hole 5*b* with respect to the spinning rotor 3 can already be obtained through the widest possible extension of the cleaning head 4 from the receptacle 6. However, as an alternative or in addition, a stop 11 could also be provided, which makes contact with the spinning rotor 3 and thus enables an even more precise positioning relative to it, as shown in FIGS. 5 and 6.

Figure 5:
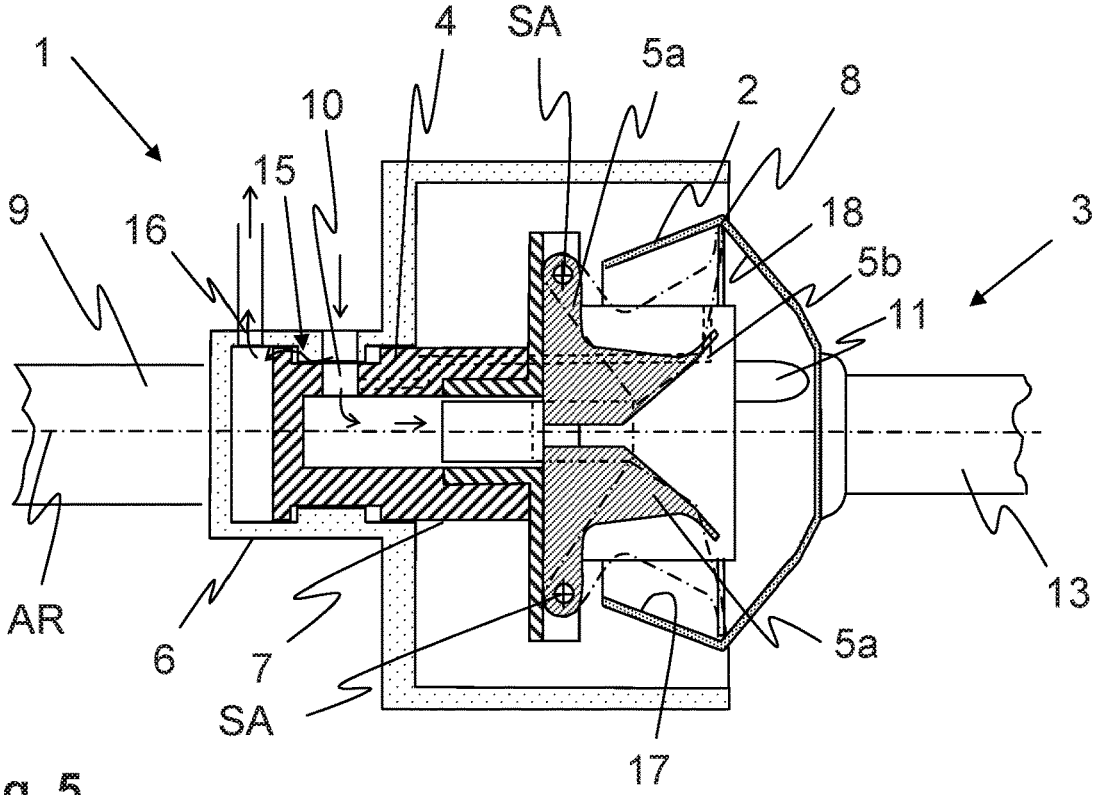
FIG. 5 is a schematic, sectional view of a cleaning device according to an additional design, whereas the cleaning device is fed to a spinning rotor.

FIG. 5 shows an additional design of a cleaning device 1, which features, as cleaning elements 5, both two scrapers 5*a* and a blow hole 5*b*. Herein, through the air supply 10, compressed air can be fed to the cleaning head 4, and the piston 14 can be displaced, which in turn actuates the scrapers 5*a*. For reasons of clarity, the backlash of the cleaning head 4 or the gaps x are not shown in FIGS. 5 and 6. An exhaust opening 16 is herein allocated to the air chamber 12. If, upon the impact of the piston 14 or upon the actuation of the scrapers 5*a* with compressed air, which is fed through the air supply 10, compressed air arrives in the air chamber 12 through the overflow opening 15, this can escape through the exhaust opening 16 without any problem. Thus, as shown in FIGS. 1 to 3, the cleaning head 4 is mounted in a floating manner in or on the receptacle 6, such that an automatic adjustment of the cleaning head 4 in the axial direction is possible, and the rotor groove 8 can be cleaned by means of the scrapers 5*a*.

Figure 6:
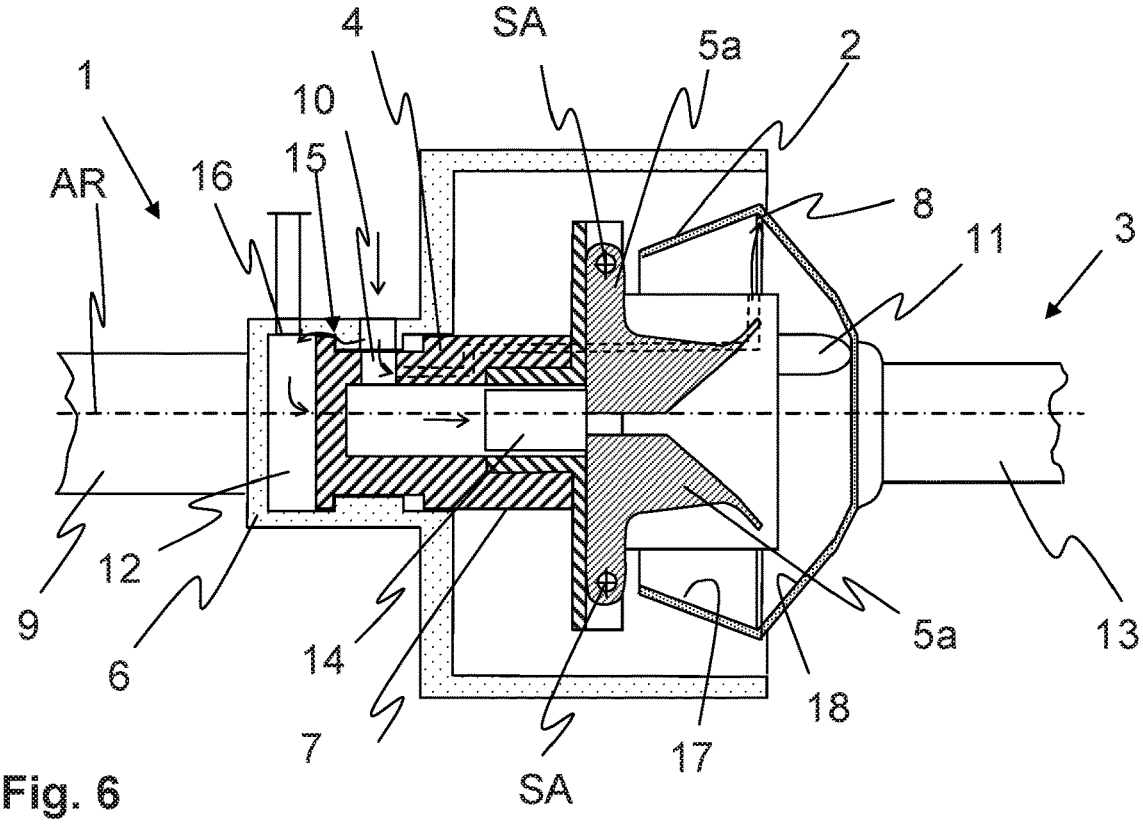
FIG. 6 is the cleaning device of FIG. 5 in an additional position, in which an additional cleaning element is used.

However, if there is a desire to clean the rotor groove 8 or a different area of the spinning rotor 3 by means of the blow hole 5*b*, and not by means of the scraper 5*a*, the exhaust opening 16 can be closed by means of a shut-off valve (not shown), as symbolized in FIG. 6 by means of a line in the area of the exhaust opening 16. As a result, upon the subjecting of the cleaning head 4 with compressed air, as described in FIG. 4, compressed air also arrives in the air chamber 12 through the overflow opening 15, such that the cleaning head 4 is displaced to the right in the axial direction AR (see arrow). In the present case, a stop 11 is arranged on the cleaning head 4, which makes contact with the spinning rotor 3 upon axial displacement, such that the cleaning head 4 is automatically positioned correctly with respect to the spinning rotor 3, in particular with respect to the rotor groove 8 of the spinning rotor 3. In the present case, the stop 11 makes contact with the rotor base 18 of the spinning rotor 3.

With the design shown in FIGS. 2 and 3 with an exhaust opening 16 that can be shut off, it is possible for the cleaning head 4, as shown in FIGS. 1-3, to be mounted in a free-floating manner within the receptacle 6, in order to automatically position the scrapers 5*a*, and enable the subjecting of the air chamber 12 after the shut-off of the exhaust opening 16, which actively pushes the cleaning head out of the receptacle 6. Therefore, the cleaning head 4 or the cleaning device 1 shown in FIGS. 5 and 6 can be used in a particularly flexible manner. Likewise, for the cleaning device 1 with such an air chamber 12 that can be shut off, it is also conceivable to design the cleaning head 4 in two or more parts, as is also shown in FIGS. 5 and 6. Thus, in a simple manner, different cleaning elements 5 can be arranged on the cleaning device 1 in a replaceable form. Of course, such a two-part design of the cleaning head 4 could also advantageously be used in the cleaning devices 1 of FIGS. 1 to 4.

This invention is not limited to the illustrated and described embodiments. Variations within the scope of the claims, just as the combination of characteristics, are possible, even if they are illustrated and described in different embodiments.

LIST OF REFERENCE SIGNS

1 Cleaning device
2 Rotor disk
3 Spinning rotor
4 Cleaning head
5 Cleaning element
5*a* Scraper
5*b* Blow hole
6 Receptacle
7 Bearing area
8 Rotor groove
9 Feed unit
10 Air supply
11 Stop
12 Air chamber
13 Rotor shaft
14 Piston
15 Overflow opening
16 Exhaust opening
17 Slide wall
18 Rotor base
AR Axial direction
SA Scraper axis
X Gap

The invention claimed is:

1. A cleaning device for cleaning a rotor disk of a spinning rotor, comprising:

a receptacle mounted to a feed unit configured for positioning the receptacle relative to the spinning rotor in an axial direction;

a cleaning head comprising at least one bearing area on a proximal end slidingly mounted in the axial direction in a floating manner inside the receptacle, the cleaning head comprising a distal end with at least one pivotably mounted cleaning element for cleaning the spinning rotor;

an actuator in the cleaning head configured to angularly position the at least one pivotably mounted cleaning element; and wherein during operation the receptacle is axially positioned by the feed unit relative to the spinning rotor, the actuator actuates the at least one pivotably mounted cleaning element to angularly position for engagement with the rotor disk of the spinning rotor, and engagement of the cleaning element with the rotor disk axially moves the cleaning head relative to the receptacle in the floating manner along the at least one bearing area.

2. The cleaning device according to claim 1, wherein a degree of floating axial play between the cleaning head and the receptacle along the at least one bearing area is defined by a backlash in the axial direction of the cleaning head relative to the receptacle.

3. The cleaning device according to claim 1, wherein the cleaning head comprises an air supply and the actuator comprises a piston axially actuated by compressed air from the air supply from a retracted piston position to an extended piston position to engage and actuate the at least one pivotably mounted cleaning element.

4. The cleaning device according to claim 3, wherein the receptacle comprises an air chamber in communication with the air supply through an overflow opening.

5. The cleaning device according to claim 4, wherein the air chamber comprises an exhaust opening configured with a shut-off valve.

6. The cleaning device according to claim 1, wherein the cleaning element is a scraper movably mounted on the cleaning head so as to extend into the rotor disk when moved relative to the cleaning head.

7. The cleaning device according to claim 6, wherein during the extending of the scraper, the cleaning head is movable along the receptacle within a degree of floating axial play between the cleaning head and the receptacle along the at least one bearing area to position the scraper in the axial direction with respect to a rotor groove of the rotor disk.

8. The cleaning device according to claim 1, wherein the cleaning element further comprises a blow hole in communication with an air supply in the cleaning head for supplying compressed air to the blow hole.

9. The cleaning device according to claim 8, wherein by supplying the blow hole with compressed air, the cleaning head is caused to be positioned in the axial direction with respect to a rotor groove of the rotor disk.

10. The cleaning device according to the claim 9, wherein the cleaning head comprises a stop disposed to position the cleaning head in the axial direction with respect to the rotor groove.

11. The cleaning device according to claim 1, wherein the at least one bearing area is defined by a circumferentially extending groove along which the cleaning head is mounted inside the receptacle, the groove defining axial limits of a degree of floating axial play between the cleaning head and the receptacle along the at least one bearing area.

* * * * *